United States Patent [19]

Schuetz

[11] 4,419,074

[45] Dec. 6, 1983

[54] HIGH EFFICIENCY GAS BURNER

[75] Inventor: Mark A. Schuetz, Belmont, Mass.

[73] Assignee: Advanced Mechanical Technology, Inc., Newton, Mass.

[21] Appl. No.: 301,296

[22] Filed: Sep. 11, 1981

[51] Int. Cl.[3] ..... F23D 13/40; F04F 5/46

[52] U.S. Cl. ..... 431/354; 431/328; 417/179; 417/194; 417/196; 417/198; 239/403

[58] Field of Search ..... 431/328, 353, 354, 355; 417/179, 198, 196, 194; 48/180 R, 180 C; 239/403, 419.5, 425.5, 429, 553, 432; 122/17, 18; 137/890

[56] References Cited

U.S. PATENT DOCUMENTS

| | | | |
|---|---|---|---|
| 474,781 | 5/1892 | Stephens et al. | 48/180 F |
| 800,019 | 9/1905 | Sadtler | 239/406 |
| 1,156,845 | 10/1915 | James | 239/553 |
| 1,352,351 | 9/1920 | Byers | 239/406 |
| 1,589,888 | 6/1926 | Lummis | 417/179 |
| 1,874,970 | 8/1932 | Hall | 431/354 |
| 2,609,871 | 9/1952 | Brumbaugh | 239/553 |
| 2,618,246 | 11/1952 | Rostek | 122/16 |
| 2,855,033 | 10/1958 | Furczyk | 239/406 |
| 3,285,240 | 11/1966 | Schmidt | 126/91 A |
| 3,659,962 | 5/1972 | Zink et al. | 431/354 |
| 3,773,075 | 11/1973 | Thompson et al. | 431/354 |
| 3,838,002 | 9/1974 | Gluntz et al. | 417/179 |
| 4,042,344 | 8/1977 | Callcott et al. | 48/197 R |
| 4,116,383 | 9/1978 | Johnson | 239/8 |
| 4,221,558 | 9/1980 | Santisi | 431/183 |
| 4,338,888 | 7/1982 | Gerstmann et al. | 122/16 |

OTHER PUBLICATIONS

"Gas-Air Mixers", data sheets of Pyronics Inc., 1770 Miles Avenue, Cleveland 28, Ohio.

Sellors, John, Jr., "Seminar of Industrial Gas Combustion", Chapter 3, pp. 6-7, Pyronics Inc., 1770 Miles Ave., Cleveland 28, Ohio.

Kroll, A. Edgar, "The Design of Jet Pumps", *Chemical Engineering Progress,* vol. 1, No. 2, pp. 21-22.

Fabris, G. and A. A. Fejer, "Confined Mixing of Multiple Jets", *Transactions of the ASME,* Jun. 1974, pp. 92-96.

Fejer, A. A., W. G. Hermann and T. P. Torda, "Factors that Enhance Jet Mixing", manuscript released Aug. 1969, by the authors, for publication as an ARL Technical Report.

DeWerth, Schaab and Hellstern, "New and Improved Methods of Heating Localized Areas in and Around the Home", Research Bulletin 99, Catalog No. 160/DR, published Feb. 1964, by American Gas Association Laboratories, (Los Angeles), p. 22.

*Primary Examiner*—Lee E. Barrett

*Attorney, Agent, or Firm*—Hamilton, Brook, Smith and Reynolds

[57] ABSTRACT

A burner assembly provides for 100% premixing of fuel and air by drawing the air into at least one high velocity stream of fuel without power assist. Specifically, the nozzle assembly for injecting the fuel into a throat comprises a plurality of nozzles in a generally circular array. Preferably, swirl is imparted to the air/fuel mixture by angling the nozzles. The diffuser comprises a conical primary diffuser followed by a cusp diffuser.

8 Claims, 6 Drawing Figures

10
8
D
L
9
2
4
6
B
FUEL
7
AIR
AIR

HIGH EFFICIENCY GAS BURNER

GOVERNMENT SUPPORT

The government has rights in this invention pursuant to subcontract number 7381 under contract W-7405-ENG-26 awarded by the U.S. Department of Energy.

DESCRIPTION

1. Technical Field

This invention relates to the field of gaseous fuel combustion, in particular to the general class of low-pressure natural gas burners utilizing natural draft to vent the combustion products.

2. Background

The market for gaseous fuel burners, and appliances using gaseous fuel, is currently dominated by burners which utilize the buoyancy of the exhaust to vent the appliance. They are called natural draft burners and usually use the energy of the fuel jet to mix the fuel with a portion of the air required for combustion. This premixed air is called "primary air" and normally accounts for 50% or less of the air required for combustion. This mixture is ignited at the flameholder where additional air, called "secondary air", is mixed into the flame, thus providing the remainder of the air required for combustion.

Such burners are of simple construction and are formed of conventional materials and are therefore inexpensive. They dominate the market due to their low cost related to other types of burners, such as powered and pulsed combustion burners. However, they are not without faults.

One problem with conventional natural draft burners is that they normally require a large combustion chamber volume, due to the slow mixing of the fuel-primary air stream with the secondary air stream. This large volume requirement can be a disadvantage with respect to packaging considerations and also contributes to high emissions of nitrogen oxides ($NO_x$), an undesirable pollutant. If the appliance which uses this burner utilizes a heat exchanger which surrounds the combustion chamber, the large combustion chamber volume results in an unduly large, possibly expensive, heat exchanger.

In patent application Ser. No. 149,937, filed May 14, 1980, now U.S. Pat. No. 4,338,888 and assigned to the assignee of this invention, Gerstmann and Vasilakis disclose an aspirator/mixer which overcomes the above problems. That combustion system uses the force of natural gas line pressure, or less, to accelerate the fuel into the aspirator through the use of a single gas nozzle. The accelerated fuel jet aspirates sufficient air as primary air so as to achieve complete combustion without the need for any secondary air. The combustion air is thus entirely mixed with the fuel prior to combustion. This enables utilization of a small, generally closed-off combustion chamber surrounded by a heat exchanger and results in low CO (carbon monoxide) and $NO_x$ (nitrogen oxide) emissions.

The aspirator disclosed in the above-mentioned application is long and cumbersome, and therefore is undesirable from a packaging point of view. The device is long because, for proper mixing with air, the single gas jet requires a long distance before the throat of the mixer. Furthermore, the device requires a long constant diameter section before a diffuser to complete mixing of the air and fuel and thus provide a mixture with a reasonably uniform forward velocity. Such a velocity profile, with the velocity near the periphery approximately equal to the mean velocity, is critical to efficient diffuser operation.

The fact that the aspirator is long results in unacceptable noise amplification under certain operating conditions. For example, if the air inlet shutter is improperly adjusted so as to achieve less than about 37% excess air, then a loud continuous hooting sound develops. Also, when the burner described by Gerstmann and Vasilakis lights off, very often a hooting sound develops and lasts for about one second. Finally, the aspirator is expensive to manufacture, due in part to its size and in part to its unwieldy geometry, with a long taper and a diverging right angle bend.

An object of this invention is to provide an aspirator which achieves performance similar to that of the aspirator described by Gerstmann and Vasilakis in patent application Ser. No. 149,937, in that the device: (1) aspirates and mixes with the fuel all of the combustion air as primary air, (2) delivers this mixture to the combustion chamber at a slight positive pressure and (3) uses only the pressure of the fuel at line pressure or less as the driving force.

Further objects of this invention are that the device be compact, easy to package into an appliance, and less expensive to manufacture than the device described by Gerstmann and Vasilakis, and that the device not produce any loud noises during operation over a wide range of air/fuel ratios.

DISCLOSURE OF THE INVENTION

A burner assembly comprises a nozzle assembly for injecting a gaseous fuel through a throat into a diffuser to provide a mixture of fuel and air at a flame holder. The nozzle assembly provides one or more high velocity streams of fuel which draw and mix with combustion air. The fuel stream expands to an air/fuel stream having a substantially uniform velocity across the throat, the velocity of the air/fuel stream at about its outer periphery being approximately equal to the mean velocity of the air fuel stream. In the preferred form, the initial high velocity streams have a generally annular cross section formed by a plurality of nozzles in a generally circular array. Preferably, swirl is imparted to the stream by providing nozzles angled relative to the axis of the nozzle assembly and throat.

In the preferred form of the invention, the throat length is less than about one-half inch such that the air fuel mixture enters directly into a conical diffuser. To minimize the length of the diffuser assembly and its cost, a cusp diffuser is mounted at the end of the conical diffuser.

The burner assembly described is able to provide 100% premixing of the fuel and combustion air. Specifically, 100% premixing can be obtained in a four burner operating from the regulated gas pressure of 4.3 inches water column by providing a diffuser having a throat diameter of about 1.6 inches and a nozzle assembly in which nozzles, each having a diameter of 0.04 inch, are arranged in a circular array having a diameter of 0.9 inch and spaced about 1.25 inches from the throat of the diffuser.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts through the different views. The drawings are not necessarily to scale, emphasis instead being placed upon illustrating the principles of the invention.

PREFERRED EMBODIMENTS

Figure 1:
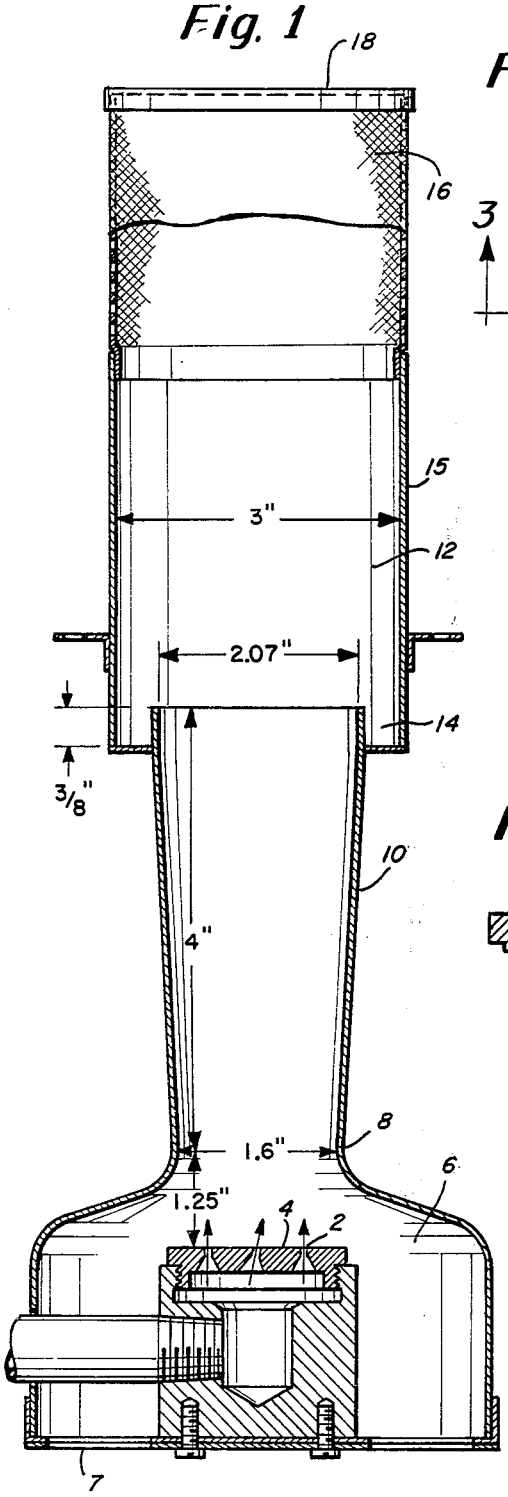
FIG. 1 is a longitudinal sectional view of a burner assembly embodying the present invention.

The preferred embodiment of a 40,000 Btu/hr burner, intended for use in the water heater invented by Gerstmann and Vasilakis, patent application Ser. No. 149,937, is shown in FIG. 1. As shown in that figure, there are eight nozzles 2 machined in a nozzle plate 4. Gaseous fuel at line pressure or less is accelerated in the nozzles 2 and is expelled as jets into the air inlet 6. In the air inlet 6, air is accelerated by the negative pressure in the throat 8, as well as by entrainment into the gas jets issuing from the eight nozzles 2. The amount of air which is aspirated can be adjusted by adjusting the open area in a shutter 7.

The eight fuel jets issuing from the nozzles 2 accelerate the combustion air and mix with the combustion air, and the jets thereby expand in width so as to fill the throat 8 of the device with a relatively high velocity mixture at a slight negative pressure relative to atmospheric pressure. This high velocity mixture is decelerated in a conical diffuser 10 so as to increase the static pressure.

Figure 2:
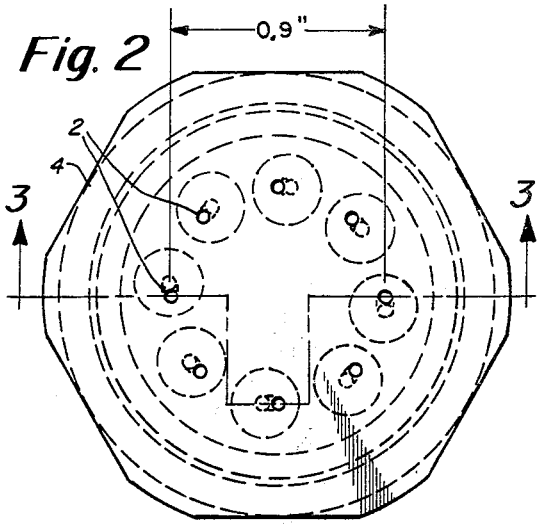
FIG. 2 is a front view of the nozzle assembly of FIG. 1.

The conical diffuser 10 discharges into a cusp diffuser 12 which comprises a cusp 14 and a constant diameter tube 15. The gas at the discharge of the cusp diffuser is at a slight positive pressure and the gas flows into the flameholder 16 which comprises a cylinder of perforated metal with a solid end cap 18. Combustion occurs on the outside of the flameholder 16, which would be located in the combustion chamber of the water heater described by Gerstmann and Vasilakis in patent application Ser. No. 149,937. The specific dimensions of the aspirator for the 40,000 Btu/hr burner are given in FIG. 1 for the aspirator and in FIG. 2 for the nozzle plate 4, where the fuel supply pressure is 4.3 inches W.C. (water column) or 1070 Pascal in S.I. units.

Figure 3:
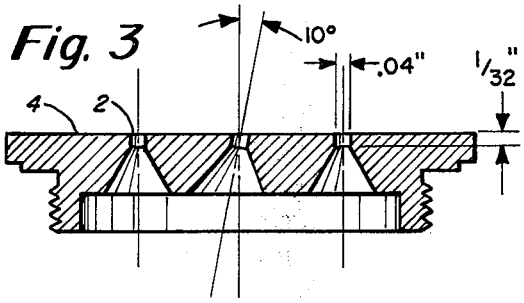
FIG. 3 is a sectional view of the nozzle assembly of FIG. 2 taken along lines 3—3.

FIG. 3 shows that the nozzles 2 are machined at a slight (10°) angle to the perpendicular. This imparts swirl to the flowing air/fuel mixture in the air inlet 6, the throat 8 and the diffusers 10 and 12. This swirling flow helps provide rapid mixing between the fuel and air, and helps to improve the efficiency of the diffusers 10 and 12. Without the swirl, this device would be capable of pumping significantly less air.

The benefits of this embodiment include all the benefits of the burner disclosed by Gerstmann and Vasilakis in that the device: (1) mixes all of the combustion air with the fuel as primary air, (2) delivers this mixture to the combustion chamber at a slight positive pressure, and (3) relies on the pressure of the fuel at line pressure or less as the driving force. Furthermore, this embodiment is significantly shorter than that device, is less expensive to manufacture than that device and does not produce loud combustion noise over a wide range of air/fuel ratios.

Proper throat diameter (1.6 inches in this case) and the diameter (0.041 inches) of the nozzles 2 are critical to correct operation of this device. The circular array should have a diameter of about 0.9 inch and it should be spaced about 1.25 inches from the throat 8. All other dimensions are less critical. However, reasonable variation in manufacturing of any dimension will not materially affect overall performance.

This embodiment is capable of mixing up to 200% of the air required for complete combustion under certain conditions. It is recognized that the actual flow through the aspirator are in part determined by downstream flow conditions. For example, the hole pattern chosen for the flameholder affects the diffuser outlet pressure, as does the pressure drop of the combustion products through any heat exchanger and up the stack. Stack draft, caused by the buoyancy of hot combustion products in a vertical exhaust vent decreases the diffuser outlet pressure. The lower the diffuser outlet pressure, the greater the flow which this aspirator can pump. Thus, there is some design flexibility in that if the pressure drops are low while stack draft is high, then less efficient aspirator performance is required to achieve the same air/fuel ratio. In practice, for reasonable pressure drops and reasonable stack draft, this device achieves 100% premixed combustion where the prior art could not, except for the device described by Gerstmann and Vasilakis.

Figure 4:
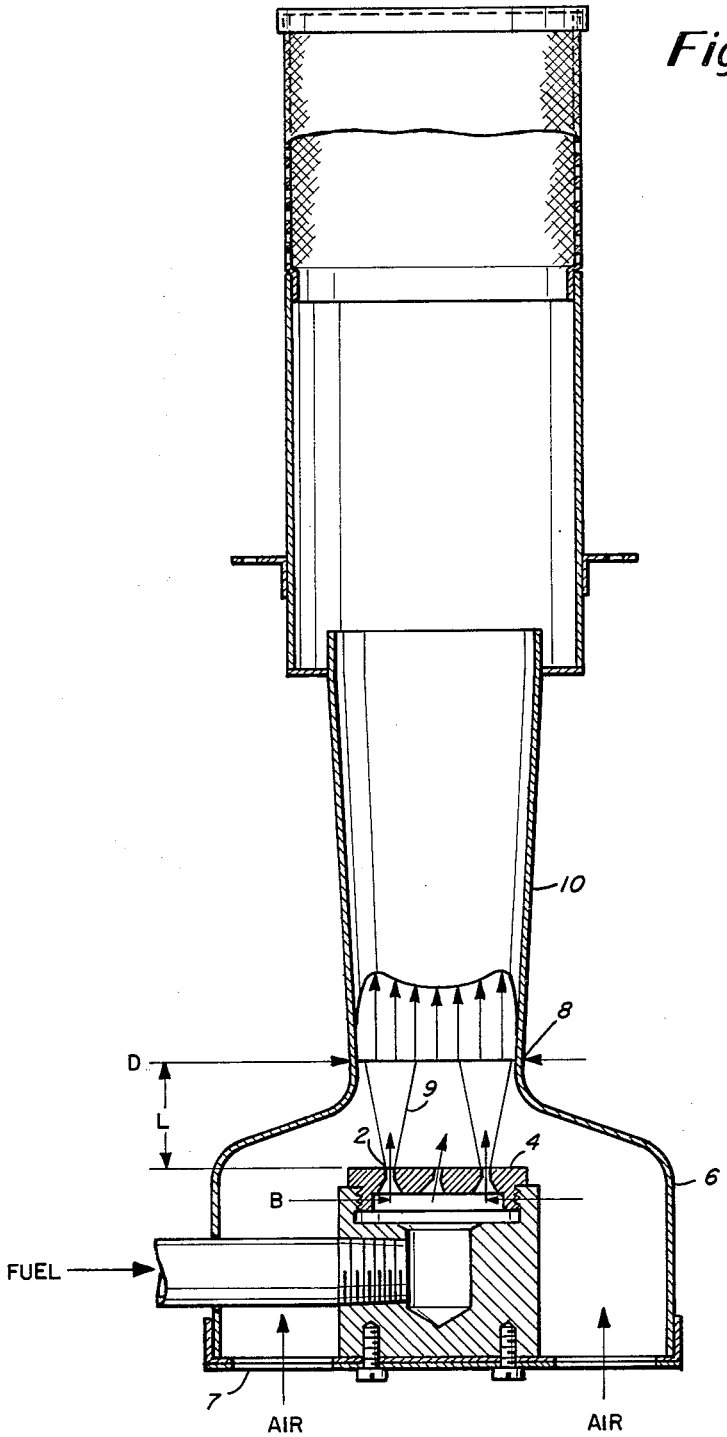
FIG. 4 is a schematic illustration of the nozzle and throat of the assembly of FIG. 1 illustrating the expansion of the initial high velocity fuel streams to an air fuel stream having a substantially uniform velocity profile.

This invention can be modified to achieve a wide range of firing rates and geometries. In order to achieve a new firing rate, first a throat diameter is determined. As a first approximation, the diameter D of the throat in FIG. 4 should be selected so as to achieve the same average velocity as that in the preferred embodiment. The nozzle arrangement should be selected so that the expanded jets 9 fill the throat 8, as shown in FIG. 4. The "bolt" circle B and the length L can be chosen with the number of jets N so as to fill the entire throat, providing a reasonably uniform velocity profile at the inlet of the conical diffuser. With such a profile, the forward velocity of the air-fuel stream at about its outer periphery is approximately equal to the mean velocity of the air-fuel stream. Thus, a maximum velocity is maintained near the periphery of the flow so as to maximize entrainment and minimize the potential for flow separation in the diffuser.

By angling the jets slightly, swirl may be introduced in the flow. The conical diffuser should have roughly the same slope as the one used in the preferred embodiment. The cusp diffuser can be designed in accordance with conventional engineering practice. It is recognized that these are only general guidelines and that precise definition of dimensions requires some degree of experimentation and empirical refinement.

The aspirator may be modified by the substitution of any generally circular array of gas jets for the one specified in the preferred embodiment. The jets should jointly have a generally annular cross-section at the nozzle assembly. A single annular jet would also suffice but would likely be more expensive to manufacture. This is because small dimensional errors would introduce large fuel flow variations, thus requiring either extremely close dimensional tolerances or an adjustment capability.

The geometry can easily be modified to suit packaging requirements in any particular applicance application. The preferred embodiment utilizes a conical diffuser followed by a cusp diffuser so as to fit the constraints of the water heater described by Gerstmann and Vasilakis. These constraints were a three-inch diameter diffuser discharge, minimum aspirator length, minimum cost, and sufficient air pumping for that particular heat exchanger and venting system. The diffuser section closest to the flame holder, in this case the cusp diffuser, must be of a material which is not corrosive at the high temperatures at that section. Such high cost material can be formed less expensively into a simple cylindrical section than into a conical diffuser, and the material need not be used in the conical diffuser which is spaced from the flame-holder.

Figure 5:
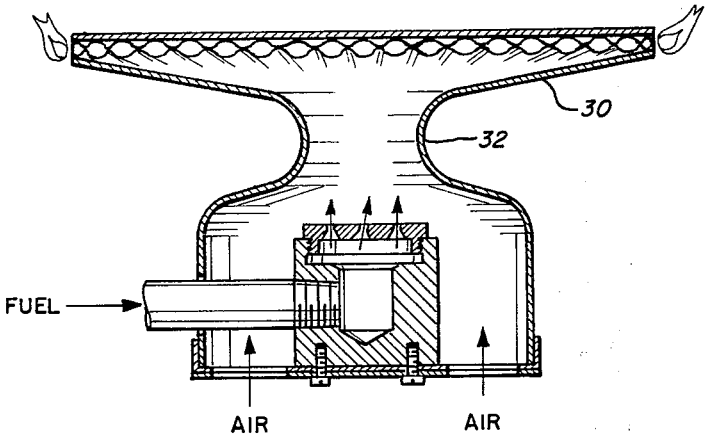
FIG. 5 is a sectional view of an alternative embodiment of the invention having a radial diffuser suitable for use in a domestic range.

It is possible to utilize this invention with any well-designed diffuser so as to fit better into an appliance. The preferred embodiment uses a generally axial diffuser. A radial diffuser could be used as shown in FIG. 5. FIG. 5 shows the radial diffuser 30 attached to the mixer throat 32 in a similar fashion as the preferred embodiment. Some minor changes such as increased swirl angle or the use of a short (½" long) straight section in the aspirator throat, may be made. This embodiment is useful in a stove top application where height should be a minimum and a large diameter is acceptable.

Figure 6:
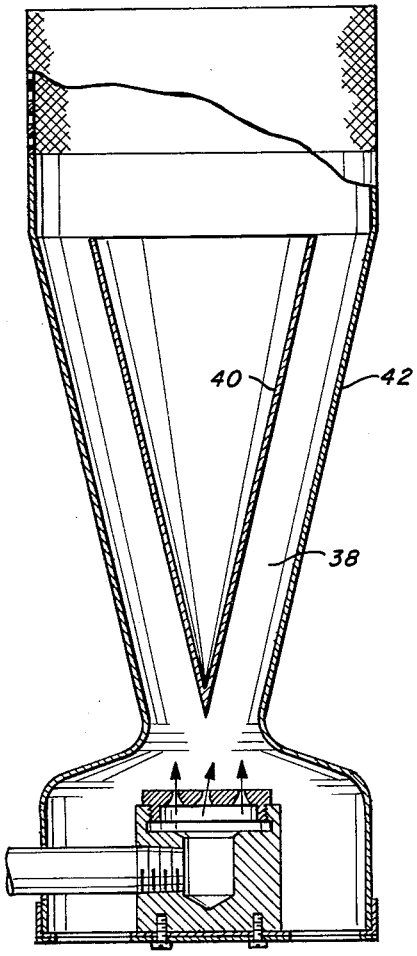
FIG. 6 is yet another embodiment of the invention comprising an annular diffuser.

Another embodiment is shown in FIG 6. This uses an annular diffuser 38 formed between conical sections 40 and 42. It is a hybrid of the axial and radial diffusers. Other diffusers could be used including: a conical diffuser without a cusp diffuser, a cusp diffuser without a conical diffuser, a Coanda effect diffuse, and so on. All of these diffusers can be found in the general engineering literature and their adaptation to this invention is relatively straightforward. Each might offer unique geometrical and/or cost benefits for varied applications.

While the invention has been particularly shown and described with reference to preferred embodiments thereof, it will be understood by those skilled in the art that various changes in form and details may be made therein without departing from the spirit and scope of the invention as defined by the appended claims.

I claim:

1. A burner assembly having a flame holder and a nozzle assembly for injecting a gaseous fuel from line pressure of 1070 Pascal or less through a throat into a diffuser to aspirate and mix with an amount of air sufficient for complete combustion of the fuel at the flame holder, the burner assembly comprising:

a nozzle assembly having a plurality of nozzles in a generally circular array, the nozzles being angled about 10° relative to the axis of the nozzle assembly and throat to provide swirl of the air fuel mixture, the fuel and aspirated air flowing directly into the throat as a stream having an outer diameter generally matching the throat diameter, the throat having a length of less than about one-half inch.

2. A burner assembly as claimed in claim 1 comprising a throat of about 1.6 inches in diameter and a nozzle assembly of nozzles having diameters of about 0.04 inches forming an array having a diameter of about 0.9 inch, the nozzle to throat distance being about 1.25 inches.

3. A burner assembly as claimed in claim 1 comprising a conical primary diffuser.

4. A burner assembly as claimed in claim 3 further comprising a cusp diffuser downstream from the conical diffuser.

5. A burner assembly as claimed in claim 1 comprising a radial diffuser.

6. A burner assembly as claimed in claim 1 comprising an annular diffuser.

7. A burner assembly having a flame holder and a nozzle assembly for injecting a gaseous fuel from line pressure of 1070 Pascal or less through a throat into a diffuser to aspirate and mix with an amount of air sufficient for comlete combustion of the fuel at the flame holder, the burner assembly comprising:

a nozzle assembly having a plurality of nozzles in a generally circular array, the nozzles being angled relative to the axis of the nozzle assembly and throat to provide swirl of the air fuel mixture, the fuel and aspirated air flowing directly into the throat as a stream having an outer diameter generally matching the throat diameter, the throat having a length of less than about one-half inch; and a conical primary diffuser followed by a cusp diffuser, the ratio of the length of the primary diffuser to the throat diameter being less than about three to one.

8. A burner assembly as claimed in claim 7 comprising a throat of about 1.6 inches in diameter and a nozzle assembly of nozzles having diameters of about 0.04 inches forming an array having a diameter of about 0.9 inch, the nozzle to throat distance being about 1.25 inches, each nozzle being angled about 10° relative to the axis of the nozzle assembly and throat.

* * * * *